US006024441A

United States Patent [19]

Nishimoto

[11] Patent Number: 6,024,441

[45] Date of Patent: Feb. 15, 2000

[54] IMAGE FORMING APPARATUS

[75] Inventor: Kazunari Nishimoto, Kawasaki, Japan

[73] Assignee: Canon Kabushiki Kaisha, Tokyo, Japan

[21] Appl. No.: 08/400,363

[22] Filed: Mar. 8, 1995

[30] Foreign Application Priority Data

Mar. 9, 1994 [JP] Japan ..... 6-038616

[51] Int. Cl.[7] ..... B41J 2/175

[52] U.S. Cl. ..... 347/85

[58] Field of Search ..... 347/85, 86, 89, 347/49

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,422,084 | 12/1983 | Salto | 347/7 |
| 4,459,600 | 7/1984 | Sato et al. | 347/47 |
| 4,463,359 | 7/1984 | Ayata et al. | 347/56 |
| 4,475,116 | 10/1984 | Sicking et al. | 347/86 |
| 4,481,244 | 11/1984 | Haruta et al. | 347/105 X |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,833,491 | 5/1989 | Rezanka | 347/43 |
| 4,908,638 | 3/1990 | Albosta et al. | 347/43 |
| 4,940,995 | 7/1990 | Hine et al. | 347/89 |

FOREIGN PATENT DOCUMENTS

| | | | |
|---|---|---|---|
| 0482775A1 | 4/1992 | European Pat. Off. | 347/43 |
| 56-34461 | 4/1981 | Japan . | |
| 62-53492 | 3/1987 | Japan . | |
| 3-46589 | 7/1991 | Japan . | |
| 5212851 | 8/1993 | Japan . | |

*Primary Examiner*—N. Le
*Assistant Examiner*—Thinh Nguyen
*Attorney, Agent, or Firm*—Fitzpatrick, Cella, Harper & Scinto

[57] ABSTRACT

An image forming apparatus includes at least one set of printing heads each adapted to print a printing medium with ink, and plural sets of ink feeding systems changeably or exchangeably usable for feeding ink to the one sent of printing heads. In addition, according to another aspect, an image forming apparatus includes a plurality of printing heads each adapted to print a printing medium with ink and a plurality of ink feeding systems changeably or exchangeably usable for feeding ink to the printing heads. In this case, each of the ink feeding systems includes an ink storing tank, a head connecting capable of detachably holding a printing head thereon, and an ink feeding passage by way of which the ink storing tank and the head connecting portion are connected to each other. A jointing portion at which the ink storing tank and the ink feeding passage are connected to each other and a jointing portion at which the ink feeding passage and the head connecting portion are connected to each other are constructed as a detachably connectable joint member.

17 Claims, 8 Drawing Sheets

IMAGE FORMING APPARATUS

BACKGROUND OF THE INVENTION

1. Field of the Invention

The present invention relates generally to an image forming apparatus. More particularly, the present invention relates to an image forming apparatus of the type having ink jet heads used therefor to print a cloth used as a printing medium with ink by ejecting ink toward the cloth.

2. Description of the Related Art

With respect to a conventional image forming apparatus as disclosed in Japanese Patent Application Laying-Open No. 34461/1981, one set of ink storing tanks and one set of ink feeding passages are arranged for one set of heads of which colors are represented by yellow (Y), magenta (M), cyan (C) and black (Bk).

On the other hand, a textile printing apparatus of the type having an ink jet system employed therefor is a technology which is increasingly known in the art in recent years. This type of textile printing apparatus has advantages that an image capable of being printed on a cloth has a high degree of freedom and a whole textile printing operation can be achieved at a reduced cost for the main reason that no original plate is required for an image to be printed on a cloth in contrast with a screen printing technology. The conventional textile printing apparatus having an ink jet system employed therefor is exemplified in Japanese Patent Application Laying-Open No. 212851/1993 but any particular description on a feeding system for an ink jet head is not seen in the foregoing official gazette.

However, in the case that the conventional ink jet printing apparatus is used as a textile printing apparatus as it is, there arises a problem as noted below. Specifically, the textile printing apparatus has a necessity for printing several kinds of clothes such as cotton, silk, polyester or the like with a same liquid of ink. It is desirable from the viewpoint of a quality of printed image on the cloth that the kind of ink is changed to other one in consideration of adaptability of the cloth to the ink. In addition, to make it possible to print the cloth with ink having a metallic color, a clear red, a clear blue or the like each of which has a difficulty in visual expression with ordinary colors of Y, M, C and Bk, it is necessary that the present kind of ink is changed to ink having a special color. To this end, when the kind of ink is changed to other one, it is necessary that ink remaining in the ink feeding system is discharged from the latter, thereafter, it is cleaned or washed, and subsequently, it is charged with a new kind of ink. However, a series of operations as mentioned above are very troublesome and time-consuming. Further, in the case that ink jet heads are detachably attached to the opponent members to make it easy to exchange the present kind of ink jet heads to other ones, the opponent members should also be cleaned or washed.

SUMMARY OF THE INVENTION

The present invention has been made in consideration of the aforementioned background.

An object of the present invention is to provide an image forming apparatus which assures that when the kind of printing medium such as cloth or the like is changed to other one, the kind of ink can easily and cleanly be changed to other one.

In a first aspect of the present invention, there is provided an image forming apparatus comprising;

at least one set of printing heads each adapted to print a printing medium with ink, and plural sets of ink feeding systems changeably or exchangeably usable for feeding ink to the one set of printing heads.

Here, the set of printing heads may be provided in the form of plural kinds of printing heads.

One set of the ink feeding system may comprise one set of ink storing tanks, one set of head connecting portions capable of detachably holding the printing heads thereon, and one set of ink feeding passages by way of which the ink storing tanks and the head connecting portions are connected to each other.

Plural set of head connecting portions may include a cover which is displaceably disposed such that only one set of head connecting portions among the plural set of head connecting portions are selectively connected to one set of the printing heads.

The image forming apparatus may include detecting means for detecting whether or not ink is supplied from ink storing tanks corresponding to one set of head connecting portions selected by the cover and controlling means for permitting only ink feeding from the ink storing tanks in response to a signal outputted from the detecting means.

The cover may be displaceably held on a main body of the head connecting portions, and while the printing heads are attached to the ink connecting portions, the cover collides against one of the head connecting portions without any possibility that the cover is displaced further, whereby other head connecting portions can not be selected.

The cover may comprise a plurality of cover members of which number is small than that of the plural sets of head connecting portions by a numeral of one, the cover members are slidably held on the main body of the head connecting portions, and among the plural sets of head connecting portions, only one set of head connecting portions are not always covered with the cover.

The printing medium may be a cloth.

Each of the printing heads may be an ink jet head for ejecting ink therefrom, and each printing operation is performed by ejecting ink from the ink jet head toward a printing medium.

The ink jet head may generate bubbles in ink by utilizing thermal energy, and ink is ejected from the ink jet head as the bubbles grow.

Each of the ink storing tanks may include a pressuring mechanism which serves to feed ink by pressuring the latter.

In a second aspect of the present invention, there is provided an image forming apparatus including a plurality of printing heads each adapted to print a printing medium with ink, and a plurality of ink feeding systems changeably or exchangeably usable for feeding ink to the printing heads, wherein each of the ink feeding systems includes an ink storing tank, a head connecting portion capable of detachably holding a printing head thereon, and an ink feeding passage by way of which the ink storing tank and the head connecting portion are connected to each other, and wherein a jointing portion at which the ink storing tank and the ink feeding passage are connected to each other and a jointing portion at which the ink feeding passage and the head connecting portion are connected to each other are constructed as a detachably connectable joint member.

At least one component among the ink storing tank, the ink feeding passage and the head connecting portion may be provided in the form of plural sets.

Here, the ink feeding passage may be provided in the form of plural sets.

Each of the jointing portions may be normally located above an ink liquid surface in the ink storing tank.

The ink storing tank may include a pressuring mechanism for feeding ink therefrom by pressuring the latter.

The printing medium may be a cloth.

The printing head may be an ink jet head for ejecting ink therefrom, and each printing operation is performed by ejecting ink from the ink jet head toward a printing medium.

The ink jet head may generate bubbles in ink by utilizing thermal energy, and ink is ejected from the ink jet head as the bubbles grow.

According to a first aspect of the present invention, it is sufficient that an available head connecting portion is changed when an ink changing operation is performed. Thus, each ink changing operation can very simply and cleanly be achieved.

Since a cover selectably cooperating only with one head connecting portion is provided, there does not arise a malfunction that ink jet heads are erroneously attached to head connecting portions.

In addition, since detecting means for detecting the displacement of the cover is provided, this makes it possible to change safely the present ink feeding system to other one.

Once printing heads are attached to the opponent head connecting portions, the cover can not be displaced any longer without any possibility that they are erroneously attached to other connecting portions.

According to a second aspect of the present invention, since the ink feeding system is divided into three parts, changing of the ink feeding system to other one can very simply be achieved merely by replacing one of the three parts with new one.

Since one of the three parts includes plural sets of components which are difficult to be disconnected from this part, changing of the ink feeding system to other one can simply be achieved.

In addition, since joint members for connecting the divided three parts to each other are normally located above the liquid surface of ink in each ink storing tank, when the joint members are disconnected from the other parts, ink returns to the ink storing tank by its own dead weight, resulting in the ink feeding system being kept very clean.

When each ink storing tank includes a pressuring mechanism, each ink jet head can recoverably be activated.

The above and other objects, effects, features and advantages of the present invention will become apparent from reading of the following description of embodiments thereof taken in conjunction with the accompanying drawings.

DESCRIPTION OF THE PREFERRED EMBODIMENTS

The present invention will now be described in detail hereinafter with reference to the accompanying drawings which illustrate preferred embodiments thereof. However, the present invention should not be construed as being limited only to these embodiments.

First Embodiment

Figure 1:
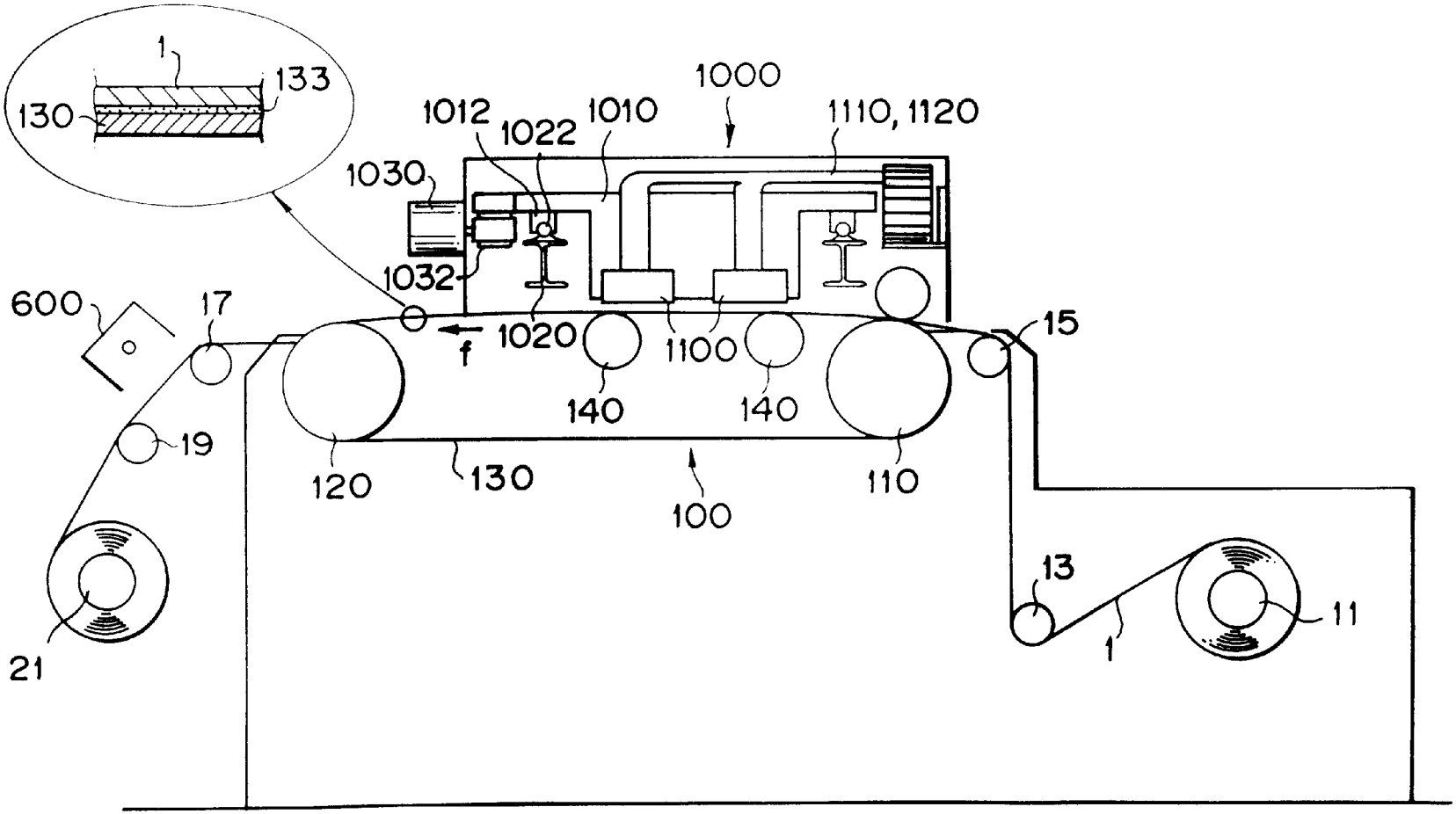
FIG. 1 is a schematic sectional side view showing the structure of the image forming apparatus according to an embodiment of the present invention.

FIG. 1 is a sectional side view which schematically shows the structure of an image forming apparatus of the present invention serving as a textile printing apparatus. In FIG. 1, reference numeral 1 denotes a cloth usable as a printing medium. As an unwinding roller 11 is rotated, the cloth 1 is unwound from the unwinding roller 11 so that it is conveyed by a conveying section 100 facing to a printer section 1000 in the substantially horizontal direction via intermediate rollers 13 and 15, and thereafter, the cloth 1 is wound about a winding roller 21 via a feeding roller 17 and an intermediate roller 19.

The conveying section 100 includes as essential components a conveying roller 110 disposed on the upstream side of the printer section 1000, a conveying roller 120 disposed on the downstream side of the same, an endless conveying belt 130 bridged between both the conveying rollers 110 and 120 while extending therebetween, and a pair of platen rollers 140 for expansively holding the conveying belt 130 with an adequate intensity of tension to keep the printing surface of the cloth 1 flat with improved flatness when a printing operation is performed with the cloth 1 in the printing section 1000. In this embodiment, the conveying belt 130 is made of a metallic material as disclosed in Japanese Patent Application Laying-Open No. 212851/1994, and a tacky layer (sheet) 133 is placed on the conveying belt 130 as illustrated on an enlarged scale within an elliptical zone at the left upper part of FIG. 1. While the cloth 1 is conveyed in that way, it is brought in adhesive contact with the conveying belt 130 in the presence of the tacky layer 133 in cooperation of a press roller 150 with the conveying roller 120, whereby the flatness of the cloth 1 is reliably maintained during the printing operation.

As the cloth 1 is conveyed while maintaining its flatness in that way, a printing agent is applied to the cloth 1 from the printing section 1000 within the range between both the platen rollers 140, and subsequently, the cloth 1 is peeled from the conveying belt 130 and the tacky layer 133 at the position coincident with the conveying roller 120 so that it is wound about the winding roller 21. In the course of the winding operation, the cloth 1 is dried by actuating a drying heater 600. This drying heater 600 is advantageously employable especially in the case that liquid is used as a printing agent. The drying heater 600 is typically exemplified by a blower for blowing hot air toward the cloth 1 and a lamp for irradiating infrared rays toward the cloth 1.

Figure 2:
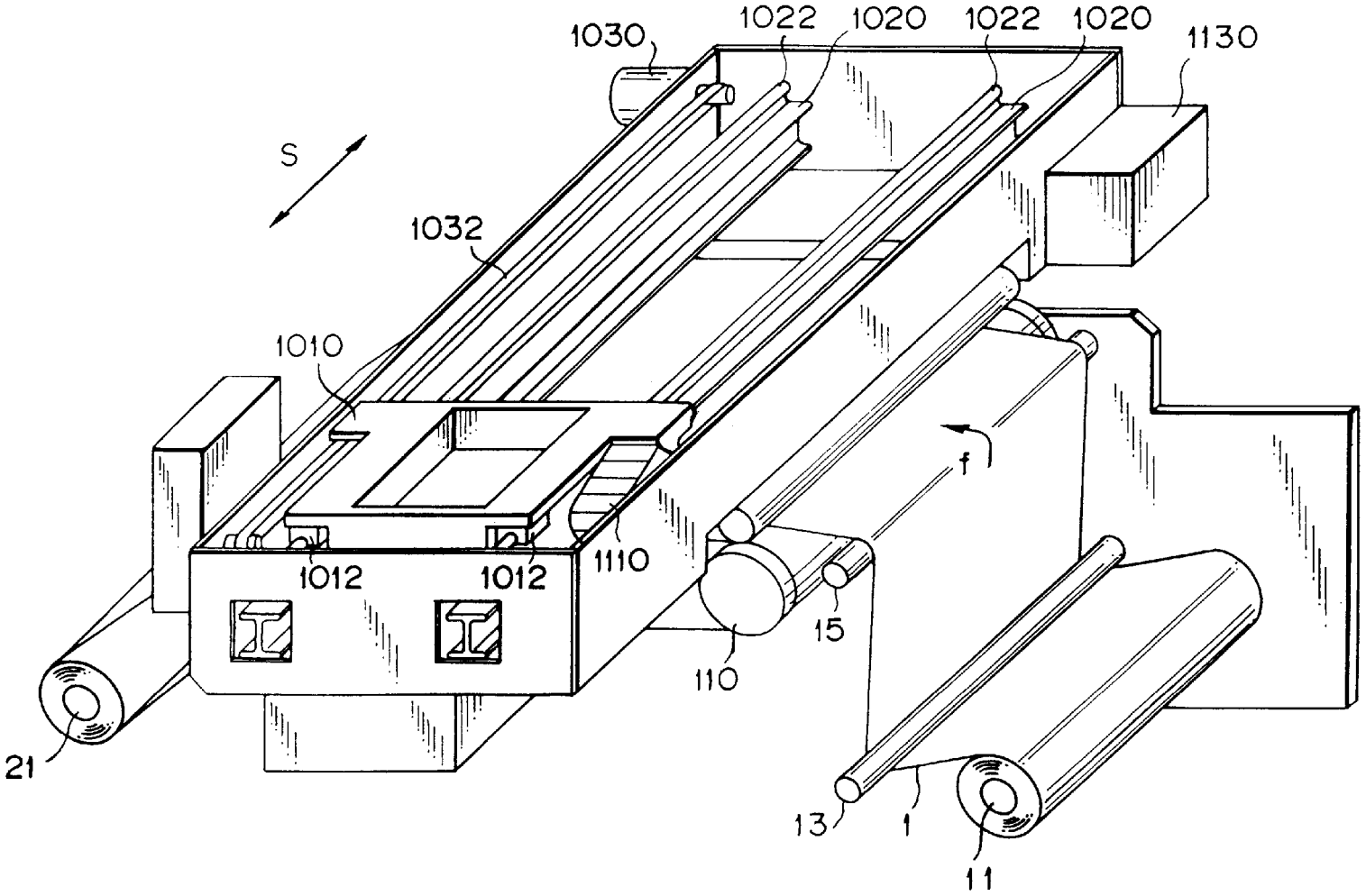
FIG. 2 is a fragmentary perspective view showing a printer section and a conveying section constituting the image forming apparatus shown in FIG. 1.

FIG. 2 is a perspective view which schematically shows the printing section 1000 and a conveying system for the cloth, and the structure of the printer section 1000 will be described below with reference to FIG. 1 and FIG. 2.

As shown in FIG. 1 and FIG. 2, the printer section 1000 includes a carriage 1010 adapted to be scanned in the direction different from the f arrow-marked conveying direction of the cloth 1, e.g., in the S arrow-marked transverse direction perpendicular to the f arrow-marked conveying direction. A pair of support rails 1020 extend in the S arrow-marked direction (main scanning direction). In the shown case, two support rails 1020 slidably support sliders 1012, each fixedly secured to the carriage 1010, via slide rails 1022 thereon for the purpose of guiding the slidable movement of the sliders, 1012. Reference numeral 1030 designates a motor which serves as a driving power source for performing main scanning for the carriage 1010. The driving power generated by the motor 1030 is transmitted to the carriage 1010 via an endless belt 1032 and other associated components.

The carriage 1010 includes a plurality of printing heads 1100 each having a number of printing agent applying elements arranged therein in the predetermined direction (i.e., in the f arrow-marked conveying direction in this embodiment). It should be noted that the printing heads 1100 are received in the carriage 1010 in the direction different from the foregoing predetermined direction (i.e., in the s arrow-marked main scanning direction in this embodiment) with two-staged structure as viewed in the conveying direction. In more detail, a plurality of printing heads 1100 are arranged at each stage corresponding to plural kinds of printing agents each exhibiting a different color in order to enable a color printing operation to be performed therewith. The kind of color to be employed for each printing agent and the number of printing heads can adequately be selected corresponding to an image to be formed on the cloth 1. For example, an image is formed by using three kinds of primary colors composed of yellow (Y), magenta (M) and cyan (C). Alternatively, an image may be formed by using four kinds of colors composed of three primary colors and black (Bk). In the case that desired expression can not be attained or can hardly be attained merely with three primary colors, an image is formed by using a special color (e.g., a metallic color such as gold color, silver color or the like, a clear red color or a clear blue color) in place of the three primary colors or in addition to the same. Otherwise, an image may be formed by using plural kinds of printing agents each exhibiting a same color but having a different density.

In this embodiment, as shown in FIG. 1, a plurality of printing heads 1100 arranged in the S arrow-marked main scanning direction are received in the carriage 1010 with two-staged structure as viewed in the f arrow-marked conveying direction. The kind of color to be exhibited by a printing agent used by each printing head at each stage, the number of printing heads arranged at each stage and the order of arrangement of the printing heads are same at each stage or they may differ from stage to stage corresponding to an image to be printed. The image range printed in response to main scanning performed for the printing heads at the first stage can repeatedly be printed by the printing heads at the second stage. In this case, an image may complementarily be formed by the printing heads at each stage while the printing of a part of the image is omitted. Alternatively, an image may be printed in the overlapped state by the printing heads at both the stages. Otherwise, an image may be printed at a high speed while a unit printing range is distributively allocated to each of the printing heads at both the stages. It should be noted that the number of stages each including a plurality of printing heads should not be limited only to two stages but it may be one stage or three or more stages.

In this embodiment, an ink jet head, e.g., a bubble jet head named by Canon Corp. is used as a printing head 1100. In detail, the bubble jet head includes a plurality of heat generating elements each adapted to generate thermal energy as energy to be utilized for ejecting ink therefrom by allowing a phenomenon of film boiling to appear in ink. As the cloth 1 is conveyed by the conveying section 100 in the substantially horizontal direction, ink is ejected toward the cloth 1 from a plurality of ink ejecting orifices each serving as a printing agent applying element with a downward attitude. At this time, since ink ejection is achieved without any difference in pressure head among the ink ejecting orifices, an excellent image can be formed under uniform ejecting conditions, and moreover, uniform recovering treatment can be conducted for all the ink ejecting orifices.

To properly follow the displacement of the carriage 1010, a flexible cable 1110 is connected to each printing head 1100. Thus, head driving signals and head state informing signals are sent and received between the printing heads 1100 and a controlling unit (not shown). In addition, colored inks each having a different color are fed to the printing heads 1100 from an ink feeding system 1130 having respective colored inks received therein, via a plurality of flexible tubes 1120.

Figure 3:
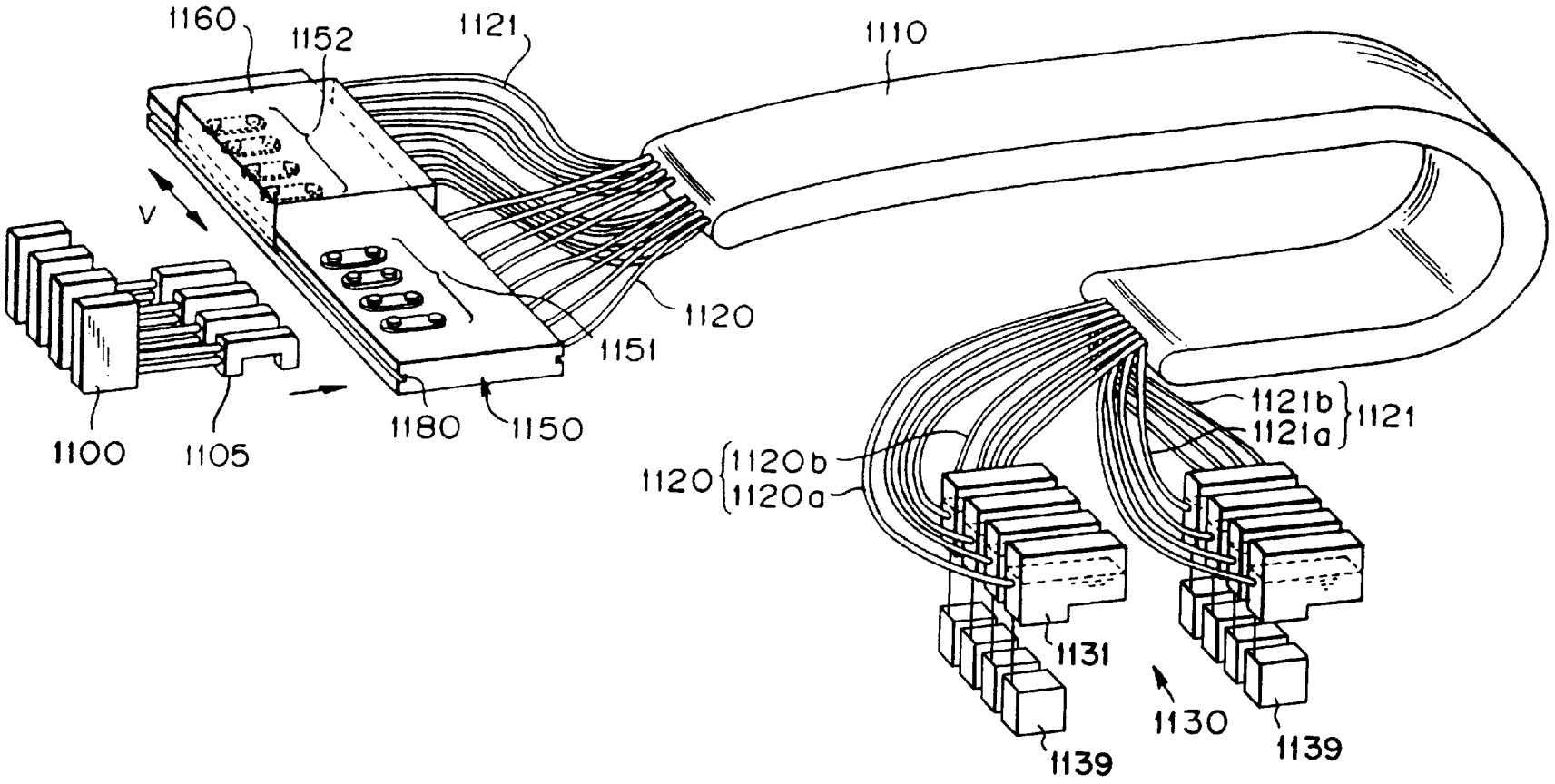
FIG. 3 is a perspective view showing an ink feeding system for the image forming apparatus according to a first embodiment of the present invention.

FIG. 3 is a perspective view which schematically shows the ink feeding system 1130 constructed in accordance with the first embodiment of the present invention. This ink feeding system 1130 is composed of two systems. Specifically, a first system is such that a plurality of first ink feeding tubes 1120 connected to one set of first ink storing tanks 1131 extend through the flexible cable 1110 until they are connected to a head connecting section 1150. Similarly, a second system is such that a plurality of second ink feeding tubes 1121 connected to one set of second ink storing tanks 1132 extend through the flexible cable 1110 until they are connected to the head connecting section 1150. Each of the first ink feeding tubes 1120 forms a recirculation passage which is composed of a forward ink feeding tube 1120*a* and a return ink feeding tube 1120*b*, while each of the second ink feeding tubes 1121 forms a recirculation passage which is composed of a forward ink feeding tube 1120*b* and a return ink feeding tube 1121*b*. Each of the ink storing tanks 1131 and 1132 includes a pressurizing pump 1139. With this construction, as shown in FIG. 3, as ink in each ink storing tank 1131 is pressurized by the pressurizing pump, it recirculates in the printing head 1100 via the forward ink feeding tube 1120*a* and then returns to the ink storing tank 1131 via the return ink feeding tube 1120*b*. Similarly, as ink in each ink storing tank 1132 is pressurized by the pressurizing pump, it recirculates in the printing head 1100 via the forward ink feeding tube 1121*a* and then returns to the ink storing tank 1132 via the return ink feeding tube 1121*b*. Each of the ink feeding tubes 1120 and 1121 can be refilled with ink by actuating the pressurizing pump, and moreover, recovering treatment can be conducted by discharging a fraction of ink from an ink ejection port while ink recirculates in the printing head 1100. A plurality of ink storing tanks 1131 and a plurality of ink storing tanks 1132 are provided corresponding to printing agents each having a different color so as to enable a color printing operation to be performed. The number of each set of ink storing tanks can arbitrarily be selected depending on an image to be formed on the cloth 1. For example, the foregoing number is three corresponding to three printing primary colors composed of yellow (Y), magenta (M) and cyan (C). Otherwise, it is four corresponding to the three printing primary colors (Y). (M) and (C) plus black (Bk). In addition, a special color (metallic color such as gold color, silver color or the like or clear red, clear blue or the like each capable of visually recognized by mixing three primary colors with each other but difficult to be clearly recognized by any one) incapable of being or difficult to be visually expressed with three primary colors can be used in place of these primary colors or in the presence of these primary colors. Alternatively, a plurality of printing agents each having a same color may be used corresponding to a density of image to be formed on the cloth 1.

The head connecting section 1150 is composed of one set of first head connecting portions 1151 represented by solid line in FIG. 3, one set of second head connecting portions 1152 as represented by phantom lines in FIG. 3, and a connecting portion cover 1160.

Figure 4A:
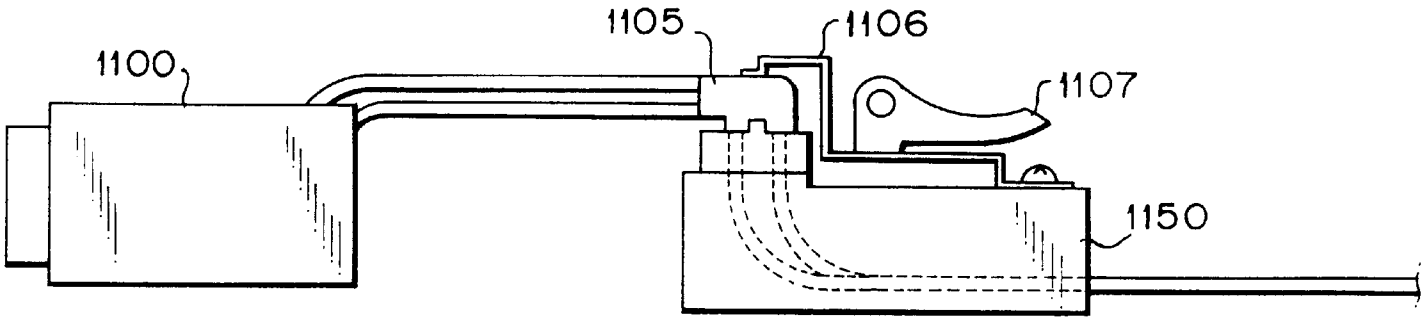
FIG. 4A and FIG. 4B are cross-sectional views showing the structure of a head connecting mechanism for the image forming apparatus according to the first embodiment of the present invention, respectively.
Figure 4B:
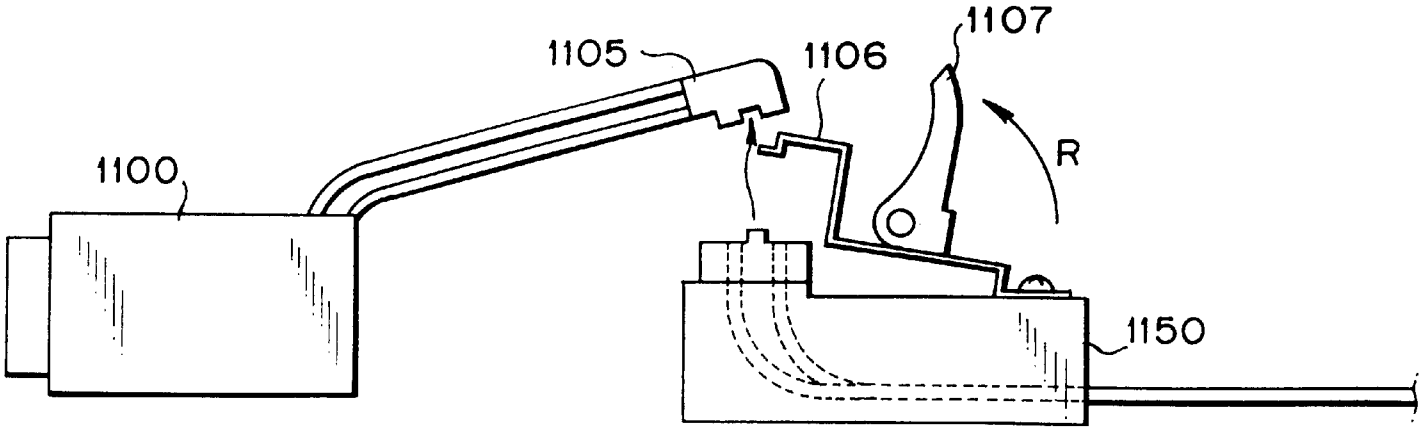

FIG. 4A and FIG. 4B are cross-sectional views which show the structure of a mechanism for attaching and detaching a head connecting portion 1105, respectively. While the attaching/detaching mechanism is lowered as shown in FIG. 4A, one set of head connectors 1105 are immovably placed on one set of head connecting portions 1151 in the connected state with the aid of a connection spring 1106 depressed by actuating a connection crank 1107. While this state is maintained, as ink flows through the ink feeding tubes 1120, it is fed to the printing heads 1100 via the head connectors 1105. On the other hand, as shown in FIG. 4B, when the connection crank 1107 is turned in the R arrow-marked direction (i.e., in the upward direction) as viewed in the drawing, the connection spring 1106 is released from the depressed state, causing the head connectors 1105 to be detached from the first head connecting portions 1151. Thus, the head connectors 1105 are ready to be attached to the second head connecting portion 1152.

As shown in FIG. 3, the connecting portion cover 1160 is engaged with grooves 1180 formed on the opposite side surfaces of the head connecting section 1150 in such a manner that it can slidably be displaced in the V arrow-marked direction as viewed in the drawing. Since the second head connecting portion 1152 is covered with the connecting portion cover 1160 when the first head connecting portions 1151 are in use, the head connectors 1105 of the heads 1100 can not be attached to the second head connecting portion 1152. Even though the connecting portion cover 1160 is intentionally displaced with a user's hand while the head connectors 1105 are attached to the first head connecting portion 1151, the connecting portion cover 1160 collides against one of the head connectors 1105. Thus, the connection portion cover 1160 can not be displaced any longer.

When ink to be fed to the printing heads 1100 is changed from ink for silk stored in, e.g., first ink storing tanks 1131 to ink for polyester cloth stored in second ink storing tanks 1132, first, the head connectors 1105 are detached from the first head connecting portions 1151 as shown in FIG. 4A and FIG. 4B. Next, the connecting portion cover 1160 is displaced in the V arrow-marked direction from the position shown in FIG. 3 until the first head connecting portions 1151 are covered with the connecting portion cover 1160. Thus, since the second head connecting portions 1152 are exposed to the outside, the head connectors 1105 are exchangeably connected to the second head connecting portions 1152. At this time, the changing from the ink for silk to the ink for polyester cloth is completed. If necessary, the printing heads 1100 may be exchanged with new ones. At this time, there does arise any necessity for exchanging the ink feeding tube 1120 with other one every time the kind of ink is changed to other one, resulting in the kind of ink being easily changed to other one. In addition, there does not arise a malfunction that ink is vaporized from an ink tubes which is not in use.

Figure 5:
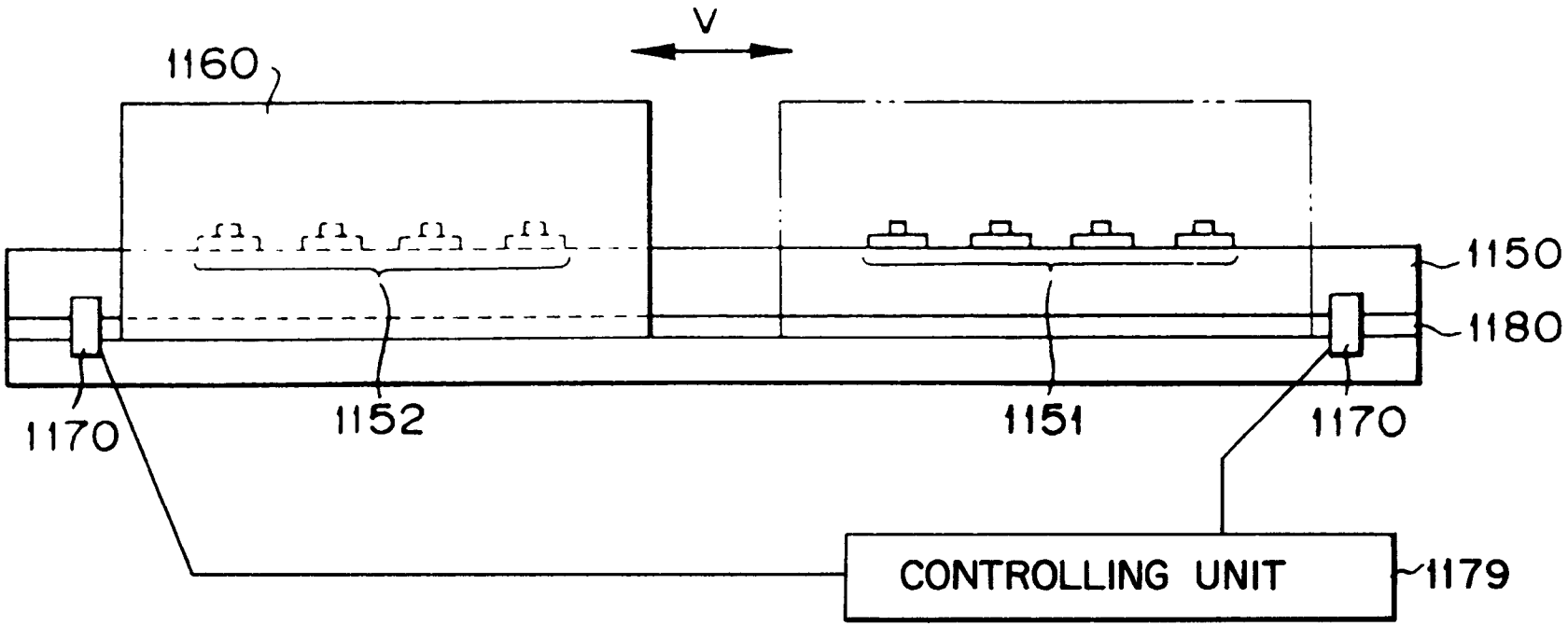
FIG. 5 is a fragmentary front view showing a head connecting section for the image forming apparatus according to the first embodiment of the present invention.

FIG. 5 shows by way of front view that microswitches 1170 are disposed in the groove 1180 for detecting the displacement of the connecting portion cover 1160. When the connecting portion cover 1160 is displaced, the microswitch 1170 detects the displacement of the connecting portion cover 1160 and then sends a command to a controlling unit 1179. On displacement of the connecting portion cover 1160 in that way, the controlling unit determines that the kind of ink to be used has been changed from the ink for silk to the ink for polyester. At the same time, the controlling unit changes the controlling for the storing tanks and takes a measure for allowing no ink to flow from the ink storing tanks which are not presently in use.

As described above, according to this embodiment, since the image forming apparatus includes two ink feeding systems each composed of ink storing tanks, ink feeding tubes and head connecting portions, to change one kind of ink to other kind of ink, it is sufficient that head connecting portions are changed to other ones in such a manner that other printing heads are exchangeably attached to the other head connecting portions. Consequently, each changing operation can be achieved very simply.

To assure that new head connecting portions are used when one kind of ink is changed to other kind of ink, the connecting portion cover should be displaced. However, since the head connection portion which has been used till now is covered with the connection portion cover when the latter is displaced, there does not arise a malfunction that the head connectors are erroneously attached to head connecting portions. In addition, since the connecting portion cover can not be displaced when the head connectors are attached to the head connecting portions because the connecting portion cover collides against one of the head connectors, a double erroneous attachment preventive effect is obtainable.

Further, since the connecting portion cover can not be displaced when the printing head is attached to the opponent head connector, and moreover, detecting means are disposed for detecting that one head connecting portion is reliably changed to other connecting portion, one ink supplying system can safely be changed to other ink supplying system.

Moreover, since the head pressurizing mechanism is provided, a recovering operation can be achieved by allowing ink to recirculate through each printing head under the pressurized condition.

Second Embodiment

Figure 6:
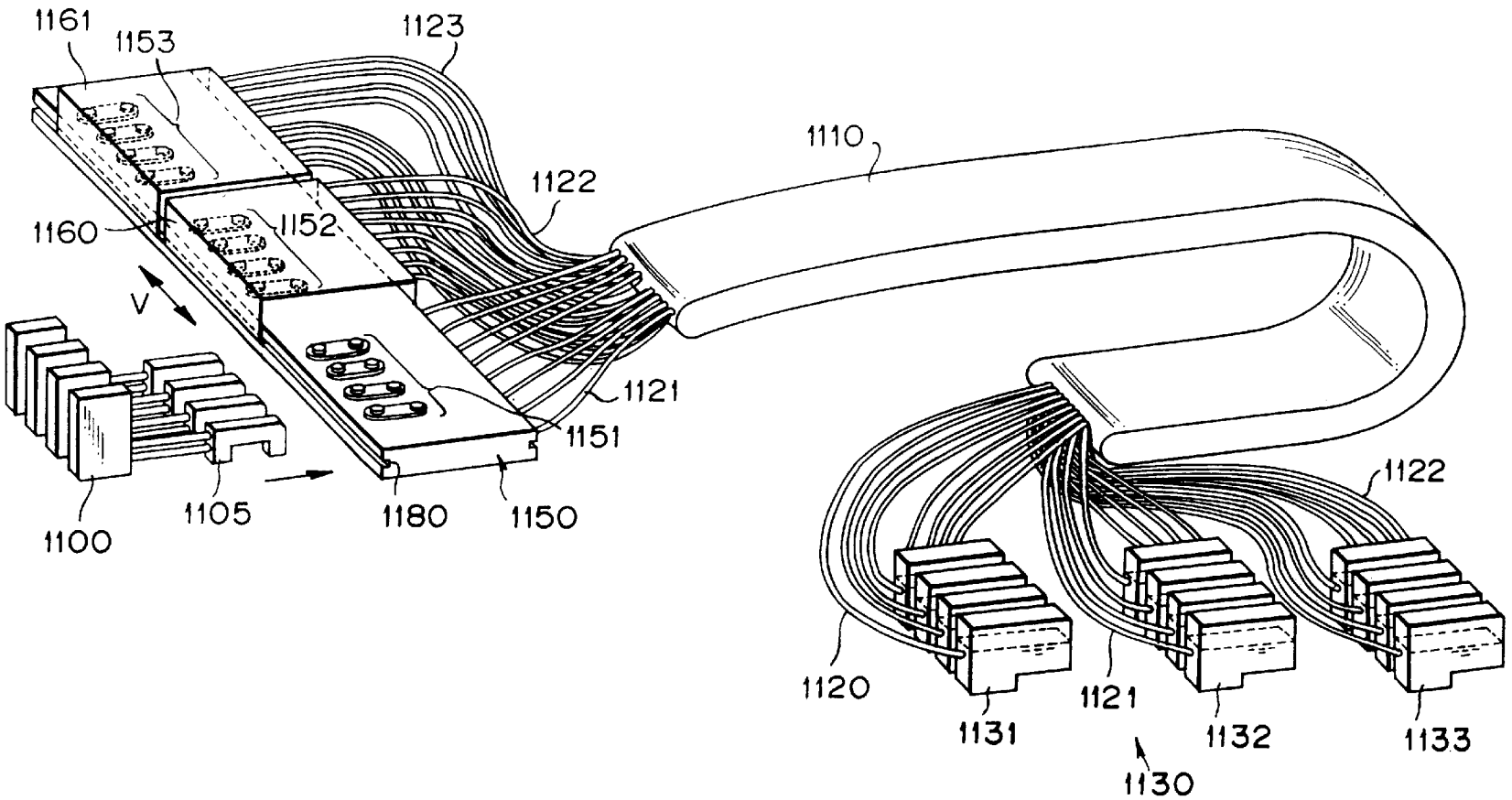
FIG. 6 is a perspective view showing an ink feeding system for the image forming apparatus according to a second embodiment of the present invention.

FIG. 6 shows a second embodiment wherein when one kind of cloth or the like is changed to other kind of the same, one kind ink can easily and cleanly be changed to other kind of ink.

A characterizing feature of the second embodiment consists in that the number of ink feeding systems is added by a numeral of one more than the number of the ink feeding systems in the first embodiment whereby one set of printing heads include three ink feeding systems. A third ink feeding system is substantially composed of one set of ink storage tanks 1131, a plurality of ink feeding tubes 1122 which are covered with a flexible cable 1110 and of which one ends are connected to the ink storage tanks 1131, and a head connecting section 1150 connected to the other ends of the ink feeding tubes 1122.

A difference in structure between the head connecting section 1150 including three feeding systems shown and the head connecting section 1150 including two ink feeding systems shown in the first embodiment consists in that the former includes a third head connecting portion 1153 corresponding to a third ink feeding system and that the former includes a second connecting portion cover 1161. Same functional members as those in the precedent embodiment are represented by same reference numerals and repeated description on these members is herein neglected for the purpose of simplification. The second connecting portion cover 1161 is slidably displaced along grooves 1180 in the same manner as the connecting portion cover 1160. With this construction, while head connectors 1105 are attached to one of the head connecting portions 1151, 1152 and 1153, both the connecting portions covers 1160 and 1161 can not be displaced because they collide against one of the head connecting portions 1151,1152 and 1153. In addition, microswitches (not shown) are disposed for detecting the displacement of both the head connecting portions covers 1160 and 1161. Thus, a controlling mechanism (not shown) electrically connected to the microswitches detects the displacement of the connecting portion covers 1160 and 1161 and then determines that the kind of ink which has been used till now is changed to other kind of ink. Subsequently, the controlling unit changes the controlling for one kind of ink storing tanks to that for other kind of ink storing tanks so as not to allow ink in the ink storing tanks which is not in use to flow therefrom.

When ink to be fed to printing heads 1100 is changed from the kind of ink stored in first ink storing tanks 1311 to the kind of ink stored in second ink storing tanks 1132, first, the head connectors 1105 are detached from the first head connecting portions 1151 as shown in FIG. 4A and FIG. 4B, and subsequently, the connecting portion cover 1160 is displaced so as to allow the first head connecting portions 1151 to be covered with the head connecting portion cover 1160. Thus, only the second head connecting portions 1152 are exposed to the outside, enabling the head connector 1105 to be exchangeably attached to the second head connecting portions 1152. Consequently, the changing of the first kind of ink to the second kind of ink has been completed.

Next, when ink to be fed to the printing heads 1100 is changed from the kind of ink stored in the second ink storing tanks 1132 to the kind of ink stored in third ink storing tanks 1133, the head connectors 1105 are detached from the second head connecting portions 1152 as shown in FIG. 4A and FIG. 4B, subsequently, the second connecting portion cover 1161 is displaced so as to allow the second head connecting portions 1152 to be covered with the second connecting portion cover 1161. Thus, only third head connecting portions 1153 are exposed to the outside. Subsequently, when the head connectors 1105 are exchangeably attached to the third head connecting portions 1153, the changing of the second kind of ink to the third kind of ink is completed.

As described above, according to this embodiment, since the image forming apparatus includes three ink feeding systems each composed of ink storing tanks, ink feeding tubes and head connecting portions, to change one kind of ink to other kind of ink, it is sufficient that head connecting portions are changed to other ones. Thus, this embodiment can cope with combination among three kinds of ink storing tanks, i.e., three kinds of inks. Consequently, each changing operation can simply be achieved.

In this embodiment, since two connecting portion covers are used for the head connecting section, they can separately be displaced. Further, since only one of three head connecting portions are exposed to the outside when one of the connecting portion covers is displaced, there does not arise a malfunction that head connectors are erroneously attached to head connecting portions.

In the aforementioned embodiment, three feeding systems are provided for one sets of printing heads. However, the present invention should not be limited only to three feeding systems. Alternatively, it of course is obvious that four or more feeding systems may be provided for one set of printing heads.

Third Embodiment

Figure 7:
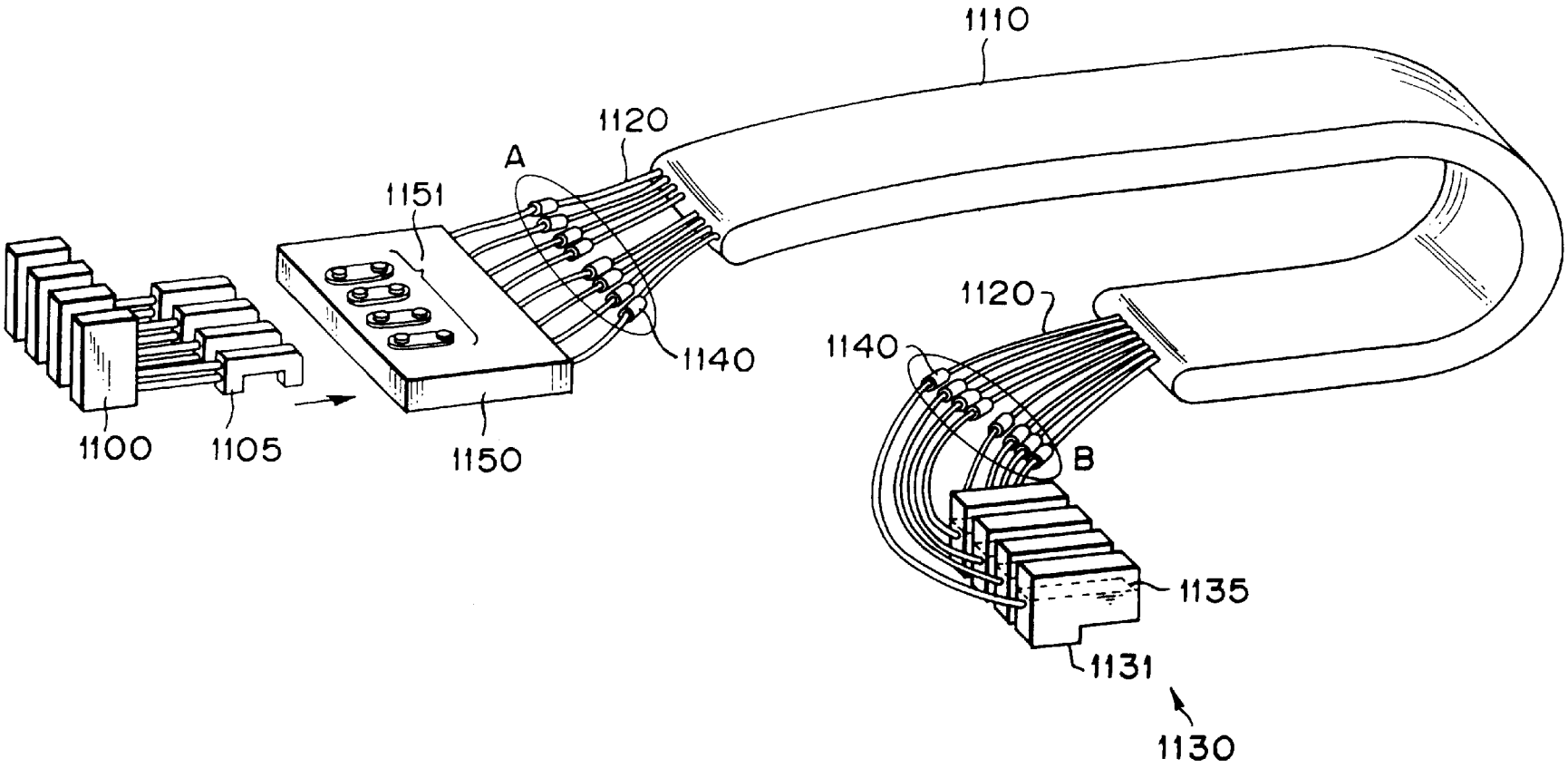
FIG. 7 is a perspective view showing an ink feeding system for the image forming apparatus according to a third embodiment of the present invention.

FIG. 7 shows a third embodiment wherein changing of one kind of ink to other kind of ink can easily and cleanly be achieved when kind of cloth is changed to other kind of cloth.

In this embodiment, a plurality of first ink feeding tubes 1120 connected to a plurality of first kind ink storing tanks 1131 extend through a flexible cable 1110, causing them to be connected to a head connecting section 1150. An ink feeding system includes a plurality of joint members 1140 at the position represented by reference character B, i.e., at the position in the vicinity of the upstream end of the flexible cable 1110 as well as at the position represented by reference character A, i.e., at the position in the vicinity of the downstream end of the flexible cable 1110, whereby the ink feeding system can be divided into three parts. The joint members 1140 are located above an ink surface level 1135 in each ink storing tank 1131. Each of the joint members 1140 is provided in the form of, e.g., a one-touch connector of which two components are simply connected to and disconnected from each other.

When one kind of ink is changed to other kind of ink, the ink feeding system is divided into three parts via the joint members 1140 located at the positions represented by reference characters A and B in the drawing.

As described above, according to this embodiment, since the ink feeding system can be divided into three parts, a changing operation or an exchanging operation can simply be achieved. It should of course be understood that the shown structure can be applied to an ink feeding system including plural sets of ink storing tanks and plural sets of head connecting sections.

Since the joint members 1140 are located above the liquid surface 1135 in each ink storing tank 1131, when three parts of the ink feeding system are correctly separated from each other, ink in each part returns to the ink storing tank by its own dead weight. Consequently, each changing operation or each exchanging operation can be achieved very cleanly.

In the case of the structure disclosed in this embodiment, each ink changing or exchanging operation can easily be achieved merely by cleaning one of the three parts separated at the positions A and B, i.e., a part composed of the flexible cable 1110 and the ink feeding tubes 1120 and exchanging the ink jet heads 1100 and the ink storing tanks 1131 located at the opposite ends of the foregoing part with new ones. In addition, with respect to the part composed of ink jet heads 1100, each ink changing or exchanging operation can easily be achieved also by exchanging only the ink jet heads 1100 separated from the head connectors 1105 with new ones and cleaning the head connecting sections 1150. When the present kind of ink is changed to other one, the interior of the flexible cable 1110 and the flexible tube 1120 is cleaned. This makes it possible to minimize the adverse influence caused by mixing the ink which is precedently used with the ink which is to be subsequently used.

Fourth Embodiment

Figure 8:
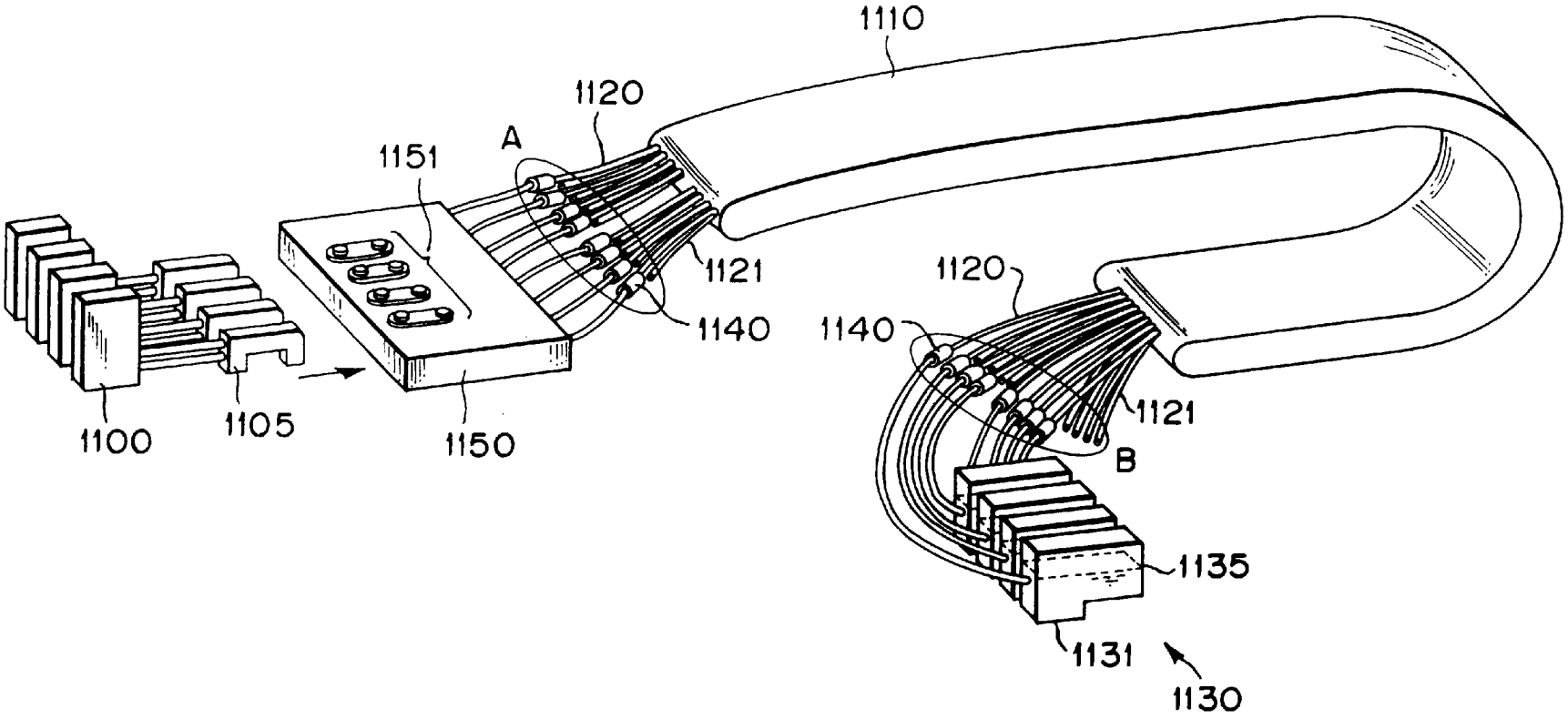
FIG. 8 is a perspective view showing an ink feeding system for the image forming apparatus according to a fourth embodiment of the present invention.

FIG. 8 shows a fourth embodiment wherein changing of one kind of ink to other kind of ink can be easily and cleanly be achieved when kind of cloth is changed to other kind of cloth.

In this embodiment, arrangement of components is same to that in the third embodiment with the exception that a plurality of second ink tubes 1121 are arranged in a flexible cable 1110 in addition to a plurality of first ink tubes 1120.

When an ink changing or exchanging operation is performed, a ink feeding system is divided into three parts while a plurality of joint members 1140 are located at the position represented by reference characters A and B in the drawing, a plurality of ink storing tanks 1131 and a plurality of head connecting sections 1150 are exchanged with new ones, and subsequently, the new ink storing tanks 1131 and head connecting sections 1150 are connected not to the first feeding tubes 1120 but to the second ink feeding tubes 1121.

A characterizing feature of this embodiment consists in that only one part of a three-separable type ink feeding system, i.e., ink feeding tubes each having poor exchangeability are divided into two systems in order to improve exchangeability of the ink feeding system.

As described above, since only one part having poor exchangeability is divided into two systems, this makes it possible to simply change one kind of ink to other kind of ink. It should be noted that the structure disclosed in this embodiment may be applied to an ink feeding system including plural sets of ink storing tanks and plural sets of head connecting sections.

The present invention has been described above with respect to four preferred embodiments wherein a cloth is used as a printing medium. However, it of course is obvious that the present invention is applicable to an ordinary roll paper, a roll-shaped film or a similar material.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 53492/1987, for example. Also, in Japanese Patent Application Publication No. 46589/1991, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori- ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. As the methods of machine stitch to make clothes and other daily needs, a widely known method can be used.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

While the present invention has been described above with respect to preferred embodiments thereof, it should of course be understood that the present invention should not be limited only to these embodiments but various change or modification may be made without departure from the scope of the present invention as defined by the appended claims.

What is claimed is:

1. An image forming apparatus comprising:

a head mounting portion for exchangeably mounting sets of printing heads, at least one set of printing heads including plural printing heads, each of said printing heads having ink ejecting orifices and being adapted to eject ink from said ink ejecting orifices onto a printing medium to print an image thereon;

at least one set of ink tanks; and plural sets of ink feeding systems, at least one set of ink feeding systems having plural ink feeding paths for feeding ink to plural printing heads corresponding to said set of printing heads, said set of ink feeding systems being connected to said set of ink tanks, each of said plural sets of ink feeding systems having a plurality of head connecting portions, wherein the number of said plurality of head connecting portions corresponds to the number of said plural printing heads included in said set of printing heads, and wherein said plurality of head connecting portions is capable of detachably connecting to said set of printing heads which is exchangeably mounted on said head mounting portion.

2. An image forming apparatus as claimed in claim 1, wherein each of said plural sets of ink feeding systems comprises one set of head connecting portions and one set of ink feeding passages by way of which said set of ink tanks and said set of head connecting portions are connected to each other.

3. An image forming apparatus as claimed in claim 2, wherein each of said ink tanks includes a pressurizing mechanism which pressurizes ink stored in said ink tank to feed ink therefrom.

4. An image forming apparatus as claimed in claim 2, further comprising a cover which is held on the set of head connecting portions corresponding to each of said plural sets of ink feeding systems, wherein said cover is displaceably disposed so as to cover the set of head connecting portions corresponding to each of said plural sets of ink feeding systems except for at least one set of head connecting portions which is selectively connected to said set of printing heads.

5. An image forming apparatus as claimed in claim 4, further comprising:

detecting means for detecting a movement of the cover and sending a command signal; and controlling means for receiving the command signal sent from said detecting means, determining a kind of ink to be used and to be supplied to at least one of said head connecting portions, and permitting the feeding of ink from said ink tanks only in response to the command signal sent from said detecting means.

6. An image forming apparatus as claimed in claim 4, wherein said cover is slidably held on said head connecting portions, and while said set of printing heads is attached to said head connecting portions, said cover is slidable to a stopped position against one of said head connecting portions, wherein in said stopped position other head connecting portions cannot be selected.

7. An image forming apparatus as claimed in claim 6, wherein said cover comprises plural cover members numbering one less than said plural sets of head connecting portions, said cover members are slidably held on said main body of said head connecting portions, and among said plural sets of head connecting portions, only one set of head connecting portions is not covered by any of said cover members.

8. An image forming apparatus as claimed in claim 1, wherein said printing medium is a cloth.

9. An image forming apparatus as claimed in claim 1, wherein each of said printing heads is an ink jet head for ejecting ink therefrom to print the image by ejecting ink from said ink jet head toward a printing medium.

10. An image forming apparatus as claimed in claim 9, wherein said ink jet head includes thermal energy generating means for generating thermal energy to form bubbles in the ink, and ink is ejected from said ink jet head as said bubbles grow.

11. An image forming apparatus comprising:

a head mounting portion for mounting a plurality of printing heads each having ink ejection orifices and each being adapted to eject ink therefrom to print an image on a printing medium; and a plurality of ink feeding systems each having a plurality of head connecting portions for feeding ink to said printing heads, and said plurality of ink feeding systems being changeably or exchangeably connected to said printing heads mounted on said head mounting portion by said head connecting portions, wherein each of said ink feeding systems includes a plurality of ink storing tanks, said plurality of head connecting portions which are capable of detachably holding a printing head thereon, a plurality of ink feeding passages by way of which said ink storing tanks and said head connecting portions are connected to each other, a plurality of first joint portions detachably connecting said ink storing tanks and said ink feeding passages, and a plurality of second joint portions detachably connecting said ink feeding passages and said head connecting portions, whereby changing or exchanging of each said ink storing tank includes detaching at least one of said first joint portions, and whereby changing or exchanging of each said ink feeding passage includes detaching at least one of said second joint portions.

12. An image forming apparatus as claimed in claim 11, wherein said each of said ink feeding systems includes a set of plural ink feeding passages.

13. An image forming apparatus as claimed in claim 11, wherein ink stored in said ink storing tank has an ink liquid surface, and said first joint portion and said second joint portion are located at a level higher than the ink liquid surface in said ink storing tank.

14. An image forming apparatus as claimed in claim 11, wherein said ink storing tank includes a pressuring mechanism for pressurizing ink stored in the storing tank to feed the ink therefrom.

15. An image forming apparatus as claimed in claim 11, wherein said printing medium is a cloth.

16. An image forming apparatus as claimed in claim 11, wherein said printing head is an ink jet head for ejecting ink therefrom to print the image by ejecting ink from said ink jet head toward a printing medium.

17. An image forming apparatus as claimed in claim 16, wherein said ink jet head includes thermal energy generating means for generating thermal energy to form bubbles in the ink, and ink is ejected from said ink jet head as said bubbles grow.

* * * * *

UNITED STATES PATENT AND TRADEMARK OFFICE

CERTIFICATE OF CORRECTION

PATENT NO. : 6,024,441
DATED : February 15, 2000
INVENTOR(S) : Nishimoto

It is certified that error appears in the above-identified patent and that said Letters Patent is hereby corrected as shown below:

Title page,
Item [*], insert:
-- [*] Notice: This patent issued on a continued prosecution application filed under 37 CFR 1.53(d) and is subject to the twenty year patent term provisions of 35 U.S.C 154(a)(2).
Item [56], References Cited, U.S. PATENT DOCUMENTS, "Salto" should read -- Saito --; and
FOREIGN PATENT DOCUMENTS, "5212851" should read -- 5-212851 --; and
Item [57], ABSTRACT, "sent" should read -- set --.

Column 2,
Line 11, "set" should read -- sets --;
Line 26, "can not" should read -- cannot --; and
Line 28, "number" should read -- the number -- and "small" should read -- smaller --.

Column 3,
Line 4, "pressuring" should read -- pressurizing --;
Line 25, "can not" should read -- cannot --; and
Line 47, "of" (first occurrence) should be deleted.

Column 4,
Line 6, "invention;" should read -- invention; and --;
Line 25, "to" should read -- toward --.

Column 5,
Line 37, "can not" should read -- cannot --; and
Line 52, "same" should read -- the same --.

Column 6,
Line 67, "(Y)." should read -- (Y), --.

Column 7,
Line 1, "color" (second occurrence) should read -- colors --;
Line 3, "visually" should read -- being visually --;
Lines 41 and 47, "can not" should read -- cannot --.

UNITED STATES PATENT AND TRADEMARK OFFICE

CERTIFICATE OF CORRECTION

PATENT NO. : 6,024,441
DATED : February 15, 2000
INVENTOR(S) : Nishimoto

It is certified that error appears in the above-identified patent and that said Letters Patent is hereby corrected as shown below:

Column 8,
Line 30, “can” should read -- can- --;
Line 35, “can not” should read -- cannot --; and
Line 48, “kind” (first occurrence) should read -- kind of --.

Column 9,
Line 1, “precedent” should read -- preceding --;
Line 9, “can not” should read -- cannot --;
Line 13, “portions” should read -- portion --; and
Line 67, “sets” should read -- set --.

Column 10,
Line 61, “be” should be deleted; and
Line 64, “same” should read -- the same --.

Column 11,
Line 2, “a” should read -- an --;
Lines 27 and 36, “processes” should read -- process --.

Column 12,
Line 7, “salt” should read -- salts --;
Line 12, “the” (second occurrence) should be deleted; and
Line 21, “polymer” should read -- polymers --.

Column 13,
Line 23, “of” should read -- for --;
Line 33, “reach” should read -- each --;
Line 44, “is” should be deleted; and
Line 66, “assemble” should read -- assembly --.

UNITED STATES PATENT AND TRADEMARK OFFICE

CERTIFICATE OF CORRECTION

PATENT NO. : 6,024,441
DATED : February 15, 2000
INVENTOR(S) : Nishimoto

It is certified that error appears in the above-identified patent and that said Letters Patent is hereby corrected as shown below:

Column 14,
Line 4, “mode” should read -- modes --;
Line 39, “change” should read -- changes -- and
Line 40, “modification” should read -- modofications --.

Signed and Sealed this

Twenty-fifth Day of February, 2003

JAMES E. ROGAN
*Director of the United States Patent and Trademark Office*